United States Patent [19]

Mogilevsky

[11] 4,076,499

[45] Feb. 28, 1978

[54] METHOD FOR WASHING CONTINUOUSLY MOVING YARN

[76] Inventor: Evsei Moiseevich Mogilevsky, Kutuzovsky prospekt, 17, kv. 9, Moscow, U.S.S.R.

[21] Appl. No.: 583,413

[22] Filed: Jun. 3, 1975

[51] Int. Cl.[2] ..... D01F 11/00

[52] U.S. Cl. ..... 8/137.5; 8/151.2; 264/197

[58] Field of Search ..... 8/137.5, 151.2, 151.1; 264/197

[56] References Cited

U.S. PATENT DOCUMENTS

| | | | |
|---|---|---|---|
| 2,237,844 | 4/1941 | Ridgeway | 8/137.5 |
| 2,326,150 | 8/1943 | MacLaurin | 8/151.1 |
| 2,427,993 | 9/1947 | McLellan | 8/151.1 |
| 2,647,040 | 7/1953 | O'Brien et al. | 8/137.5 |
| 3,046,085 | 7/1962 | Burroughs et al. | 264/197 |
| 3,415,611 | 12/1968 | Callahan et al. | 8/137.5 |
| 3,529,052 | 9/1970 | Carney et al. | 8/137.5 |
| 3,725,523 | 4/1973 | Bowen | 8/137.5 |

*Primary Examiner*—William E. Schulz
*Attorney, Agent, or Firm*—Steinberg & Blake

[57] ABSTRACT

A method for washing continuously moving freshly formed rayon yarn, which relates to the production of rayon yarn used in textile industry.

The method for washing rayon yarn consists in that yarn is washed in two successive steps. During the first step, the yarn is dipped into a bath filled with warm water having a temperature of 30° to 45° C and a pH of 1.5 to 2.5. During the second step, the yarn is sprinkled with water having a pH of 7.0 to 7.5 and a temperature of 50° to 75° C.

The method of this invention allows removing from the yarn all admixtures in a minimum of time and with a minimum of water, as well as raising the operating efficiency of spinning machines requiring no increase in their size.

7 Claims, 2 Drawing Figures

METHOD FOR WASHING CONTINUOUSLY MOVING YARN

Figure 1:
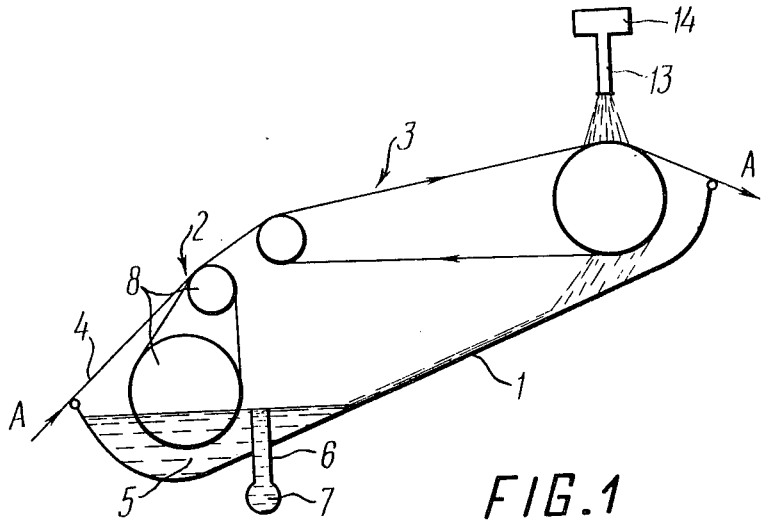

The present invention relates to the production of rayon yarn manufactured by the continuous method for further use in textile industry and, more particularly, to a method for washing freshly formed rayon yarn and an apparatus for effecting same.

At present one of the basic technological operations involved in the continuous method of producing rayon yarn is the washing of yarn, the time for said operation being strictly limited. The purpose of the washing is the maximum removal from the yarn of substances contained in the setting bath (sulphuric acid, sodium sulphate, zinc sulphate), wherein the yarn is formed, as well as the removal of admixtures which, unlike the above-mentioned compounds, are only with difficulty soluble in water. The latter components are predominantly salts of polyvalent metals (iron, copper, lead, cobalt, etc. and sulphur.

Should these compounds and admixtures be removed incompletely, the yarn acquires a tincture which mars its appearance and has an adverse effect upon the uniformity of dyeing.

In the conventional, batch, methods of manufacturing rayon yarn, the time of yarn washing is not as strictly limited as in the continuous process. In this case, however, the removal of admixtures is achieved by more sophisticated methods based on the use of liquids having differing properties to dissolve the poorly-soluble substances present in the yarn (for example, treating the yarn with caustic alkali solutions or acid solutions).

In the continuous method of yarn production, the use of such solutions calls for increasingly complicated and bulky machinery, not to mention such undesirable factors as considerable expenditures involved in the solution circulation equipment and unjustifiably great thermal losses. All these adverse features combined to keep the existing continuous yarn production techniques, whereby the yarn is treated with a plurality of different solutions, from commercial implementation.

All the known methods for the continuous production of rayon yarn currently in use provide for the washing of the yarn with water alone.

At present is it known in the art to wash continuously moving freshly formed rayon yarn by sprinkling the yarn with warm water for 35 to 40 seconds, the yarn undergoing sprinkled being entrained about pairs of guide rollers having axes intersecting in space (cf. USSR Invenntor's Certificate No. 152,940, Cl DO1d). A similar method is used in machines manufactured by British and Swiss companies.

In machines of other types, the yarn is washed with water in special through-type apparatus where the yarn is treated successively in several trays with water supplied in counterflow. The disadvantages of this method are the large size of the machinery and the high rate of water consumption.

At the same time the disadvantage of the method whereby yarn is sprinkled with warm water consists in the fact that the yarn is not washed fully or reliably enough, for the bulk of sprinkling water is out of contact with the yarn and is thus actually wasted. It should further be noted that all the processes connected with yarn washing are diffusion processes by and large dependent on the temperature and pH of the water being used. The latter two factors likewise determine the solubility of polyvalent metal salts.

And though the washing effect largely depends on the correct choice of the temperature-pH relationship, none of the prior art yarn washing methods has any provision for controlling this relationship in the washing water.

Besides, in order that the admixtures which are with difficulty soluble in water may be removed from the yarn, the washing water is to contain a certain amount of acid, whereas the yarn supplied for avivage and drying must be absolutely free from the acid.

It is an object of the present invention to obviate the above disadvantages.

It is an object of the present invention to provide a method for washing continuously moving freshly formed rayon yarn which would ensure optimum conditions for the removal of poorly soluble compounds at a minimum water consumption and with the use of simple and compact washing equipment.

The present invention contemplates providing a method for washing continuously moving freshly formed rayon yarn which would ensure optimum conditions for the removal of poorly soluble compounds at a minimum rate of water consumption and with the use of simple and compact washing equipment.

These and other objectives are attained by that in a method for washing continuously moving freshly formed rayon yarn by sprinkling the yarn with warm water, in accordance with the invention, the sprinkling water has a pH value of from 7.0 to 7.5 and a temperature of from 50° to 75° C, and the yarn is washed, prior to sprinkling, in a bath filled with water having a pH value of at least 1.5 and a temperature of at least 30° C, but not higher than that of the sprinkling water.

The invention is characterized in that the preliminary washing of the yarn is effected by dipping same into water having a pH of from 1.5 to 2.5 and a temperature of between 30° and 45° C.

The authors of the present invention have established that the preliminary washing of the yarn, following its afterregeneration, by way of dipping it into water having a pH value of from 1.5 to 2.5 and a temperature of from 30° to 45° C provides for the removal from the yarn of the bulk of the setting bath compounds and, more serious still, provides for a sufficiently complete removal of dyed polyvalent metal salts. Simultaneously, at the above-mentioned pH value, the yarn undergoes complete afterregeneration.

The subsequent step of sprinkling the yarn with water having a pH of from 7.0 to 7.5 and a temperature of from 50° to 75° C is aimed at removing from the yarn the remaining components of the admixtures as well as the last traces of the acid. In addition, such a two-step consecutive washing technique involves a far lower rate of water consumption.

The invention is further characterized in that the preliminary washing of the yarn is effected with water already used for sprinkling, which has naturally cooled down by exposure to the cooler ambient atmosphere, to a temperature of from 30° to 45° C and whose pH has reached a value between 1.5 and 2.5. This feature permits of a substantial reduction in the required amount of fresh softened water, as compared with the prior art methods.

The proposed method for washing continuously moving freshly formed rayon yarn is carried out with the aid of an apparatus comprising a bath, a pair of drive rollers arranged above said bath, the geometrical axes of said rollers intersecting in space and said rollers being enveloped by the yarn, and a means for sprinkling the yarn with water, said means being disposed above one roller of said pair of rollers, wherein, in accordance with the invention, there is installed in tha bath, upstream of said pair of rollers, an additional pair of drive rollers with intersecting geometrical axes to be enveloped by the yarn to be forwarded for sprinkling, one of said latter rollers being immersed, at least partially, in the water contained in the bath.

This arrangement provides for the fullest possible degree of washing of the yarn down to a specified permissible level of admixtures therein, requiring no sophisticated machinery nor complex maintenance procedures.

Thus, the proposed method enables admixtures to be removed from the yarn within a short period of time (30 seconds) requiring a minimum of water (not greater than 15 liters per hour per thread with the latter moving at a speed of 100 m/min). The proposed method leads to a substantially higher operating efficiency of the equipment without any increase in the size thereof.

Figure 2:
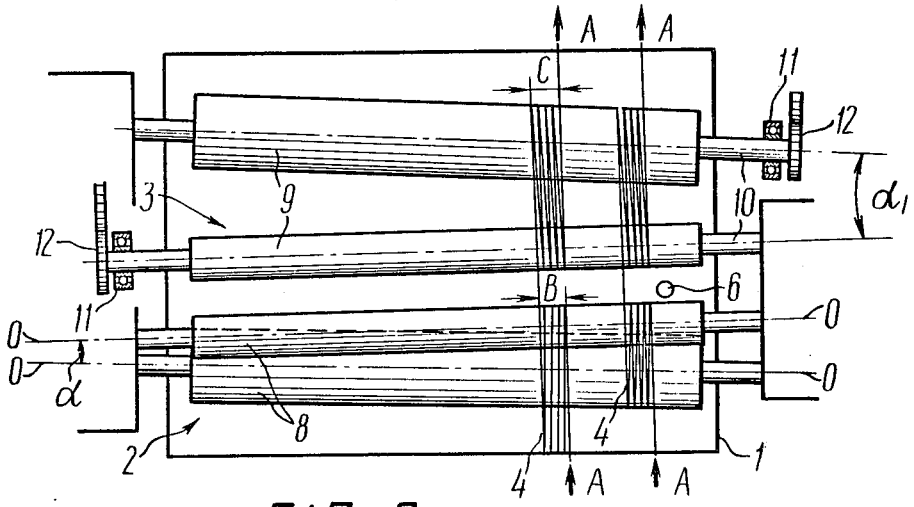

The objects and advantages of the invention will be further understood from the following detailed description of a preferred embodiment thereof taken in conjunction with the accompanying drawings, wherein:

FIG. 1 is a schematic diagram of an apparatus for washing continuously moving rayon yarn, in accordance with the method of the invention; and FIG. 2 is a plan view of the apparatus of FIG. 1.

The proposed method for washing continuously moving freshly formed rayon yarn is effected as follows.

Freshly formed yarn, i.e., yarn obtained after the steps of formation and afterregeneration, is washed with water with a view to removing therefrom the compounds found in the setting bath (sulphuric acid, sodium sulphate, zinc sulphate) as well as admixtures poorly soluble in water (iron, copper, lead, cobalt, sulfur).

The washing is effected in two successive steps. The first step consists in dipping the yarn into a bath with warm water having a temperature of from 30° to 45° C and a pH of between 1.5 and 2.5. This is the step of preliminary yarn washing, i.e., one at which the basic compounds found in the setting bath and difficultly soluble admixtures, such as polyvalent metal salts, are removed from the yarn and the residual xanthogenate in the yarn undergo complete decomposition.

The first step is immediately followed by the second step, whereat, in order to remove from the yarn the remaining admixtures (sulphuric acid, sodium sulphate, zinc sulphate, etc.), the yarn is sprinkled with warm water having a pH of from 7.0 to 7.5 and a temperature of from 50° to 75° C. To reduce water consumption, the step of preliminary yarn washing uses the water already used for sprinkling purposes, which water has naturally cooled down by exposure to the ambient atmosphere to a temperature of from 30° to 45° C and has a pH value of from 1.5 to 2.5, the drop in the pH value being attributable to the removal of acidic material such as sulphuric acid from the yarn. This water makes for the removal of poorly soluble polyvalent metal salts from the yarn.

The yarn is then forwarded for soaping and drying and then wound on spools.

The proposed method is carried out with the aid of an apparatus for washin continuously moving freshly formed rayon yarn, which apparatus is installed between the apparatus for forming and afterregenerating said yarn and the units for soaping, drying and winding the yarn on spools, the latter three units not shown in the drawings.

Referring now to the accompanying drawings, it will be seen therein that the proposed apparatus for yarn washing comprises a bath 1 (FIG. 1) and two roller pairs 2 and 3.

The bath 1 is inclined in a direction opposite to the direction in which yarn 4 is moving as indicated in FIG. 1 by the arrow A. Installed in the inclined portion 5 of the bath 1 is a vertical branch pipe 6, one end thereof communicating with a duct 7 and the other end thereof being disposed above the bottom of the bath 1, which arrangement provides for the accumulation of water in the portion 5 of the bath 1, excessive water being drained into the duct 7 via the branch pipe 6.

The roller pair 2 is disposed in the inclined portion 5 of the bath 1 and is intended to be enveloped by the rayon yarn 4 delivered thereto from the formation and afterregeneration steps. Rollers 8 of the pair 2 may be disposed in a variety of way one relative to the other, e.g. one above the other as shown in FIG. 1, the diameters thereof may be equal or different.

The rollers 8 in the pair 2 are so arranged in the bath 1 that one of them, as indicated in FIG. 1, or both are disposed below the level of the end of the branch pipe 6 protruding above the bottom of the bath 1; thus, this roller is partially immersed in the water filling the bath 1. With the roller 8 thus arranged, the yarn traveling round the same undergoes preliminary washing in the water accumulated in the portion 5 of the bath 1.

The pair 3 of rollers (FIG. 2) is disposed above the elevated end of the bath 1 and is intended to be surrounded by the yarn 4 coming from the roller pair 2. Just as the rollers 8 in the pair 2, so rollers 9 in the pair 3 may be arranged in a variety of ways one relative to the other, e.g. in the same horizontal plane, as shown in FIG. 1.

The rollers 8 and 9 of the pairs 2 and 3, respectively, are mounted on shafts 10 so arranged that the geometrical axes 0-0 thereof intersect in space, the axes 0-0 in the pairs 2 and 3 intersecting in different directions, as shown in FIG. 2, at respective angles $\alpha$ and $\alpha_1$. Owing to such an arrangement, the yarn 4 moves along the surface of the rollers of each pair in different directions; besides, the yarn 4 is thus able to move over portions B and C of the surface of the rollers of equal length arranged in opposition to each other.

The ends of the shafts 10 are secured in bearings 11 and set into rotation by a common drive, e.g. via gears 12 or swivels (not shown in the drawings). Thus rotating together with the shafts 10, the rollers 8 and 9 serve to transport the yarn 4 which is transported in spiral coils.

Disposed above the rollers 9 of the pair 3 or above one of the rollers 9 of the pair 3, as is shown in FIG. 1, is a branch pipe 13 communicating with a duct 14 to supply warm water the roller 9, said warm water having a pH of from 7.0 to 7.5 and a temperature of from 50 ° to 75° C. and serving for final washing of the yarn 4 which is then forwarded for further processing.

The water supplied onto the roller 9 flows therefrom, washing the remaining admixtures off the yarn 4 and acquiring a pH of from 1.5 to 2.0, and then flows down the bottom of the bath 1 to the inclined portion 5 thereof.

As the water flows down the bottom of the bath 1, it is exposed to the ambient atmosphere and thus naturally cools down to a temperature of from 30 to 45° C and gets accumulated in the inclined portion 5 of the bath 1. Excessive water flows through the branch pipe 6 and into the duct 7, so there is a constant influx and outflow of water in the portion 5 of the bath 1, ensuring maximum removal from the yarn of the setting bath components in the course of preliminary washing.

Practice of the novel method of this invention with the aid of the above-described apparatus is illustrated by the following two examples.

EXAMPLE 1

Following its formation and afterregeneration, in the setting bath, the rayon yarn 4 moving at a speed of 100 m/min and containing 6.0 to 7.0 percent sulphuric acid, 13.0 to 15.0 percent sodium sulphate, 0.5 to 0.7 percent zinc sulphate and other admixtures, is subjected to preliminary washing on the rollers 8 of the pair 2. This process is effected by dipping the yarn for 20 or 30 seconds into water having a temperature of from 30° to 35° C and a pH of 1.8 to 2.5, i.e., containing 1.5 to 3.0 g/lit sulphuric acid, 3.0 to 5.0 percent sodium sulphate and 0.2 percent zinc sulphate. Further treatment of the yarn 4 consists in sprinkling it with warm water having a temperature of 50° to 55° C and a pH of 7.0 to 7.5 for 20 or 30 seconds of the rollers 9 of the pair 3. Since the preliminary washing is done with water already used for sprinkling, the total amount of water consumed in the yarn washing operations is not greater than 15 liters per hour.

EXAMPLE 2

Yarn having the same parameters as in Example 1 is subjected to preliminary washing by dipping it as entrained about the rollers 8 of the pair 2 for 15 to 25 seconds into water having a temperature of 40° to 45° C and a pH of 1.5 to 2.2, i.e., containing 2.0 to 3.5 g/lit sulphuric acid, 3.5 to 5.8 percent sodium sulphate, 0.3 percent zinc sulphate and other admixtures. The yarn is then subjected to sprinkling for 15 to 20 seconds with fresh warm water having a temperature of 70° to 75° C and a pH of 7.0 to 7.5 on the rollers 9 of the pair 3. The overall quantity of water required for the washing of the yarn amounts to 12 liters per hour, provided the yarn moves at a speed of 100 m/min.

What is claimed is:

1. A method for washing continuously moving freshly formed rayon yarn, which comprises effecting, subsequent to formation and afterregeneration, preliminary washing of the freshly formed continuously moving rayon yarn by way of dipping said continuously moving yarn into and removing it from a bath filled with water having a pH of from 1.5 to 2.5, and subjecting said thus prewashed continuously moving yarn to a final wash consisting of sprinkling the continuously moving yarn with warm water having a pH of from 7.0 to 7.5 and a temperature of 50° to 75° C, thereby effecting the final washing of said yarn; said water used in said preliminary washing having a temperature of at least 30° C, but lower than that of the sprinkling water.

2. A method as set forth in claim 1, wherein the preliminary washing of the yarn by dipping is effected by use of water having a temperature of from 30° to 45° C.

3. A method as set forth in claim 2, wherein the preliminary washing of the yarn by dipping is effected by use of water already used for sprinkling which has nturally cooled down by exposure to the ambient atmosphere to a temperature of from 30° to 45° C and has acquired a pH of from 1.5 to 2.5 during sprinkling of the continuously moving yarn by becoming acidified by removing during said sprinkling acidic material from the continuously moving yarn.

4. A method as set forth in claim 1, wherein the preliminary washing of the freshly formed rayon yarn is effected by dipping the yarn a plurality of times into and removing it from said bath.

5. A method as set forth in claim 1, and including the step of maintaining the surface of the bath in which preliminary washing takes place at a constant level.

6. A method as set forth in claim 3, and including the steps of collecting the water used for sprinkling as the latter water falls from the yarn which is sprinkled thereby, and immediately directing the thus-collected water to said bath utilized for preliminary washing.

7. A method as set forth in claim 6, wherein the water used for sprinkling is continuously collected and continuously directed to said bath, and continuously removing from said bath water at approximately the same rate as the water supplied to said bath from the water utilized for sprinkling, to maintain the surface of the bath at a substantially constant level.

* * * * *